US005836614A

United States Patent [19]

Park

[11] Patent Number: 5,836,614

[45] Date of Patent: Nov. 17, 1998

[54] BOOK WITH VARIOUS SECTIONS

[76] Inventor: Nam Kyo Park, Raseong Vilra Gadong 201, 1045-25, Bisan3-Dong Dongan-Gu, Anyang-si, Kyeongki-do, Rep. of Korea

[21] Appl. No.: 815,044

[22] Filed: Mar. 14, 1997

[30] Foreign Application Priority Data

Nov. 4, 1996 [KR] Rep. of Korea ..... 1996 38212

[51] Int. Cl.[6] ..... B42D 15/00

[52] U.S. Cl. ..... 281/16; 283/631

[58] Field of Search ..... 281/15.1, 16, 29, 281/37, 38; 283/63.1

[56] References Cited

U.S. PATENT DOCUMENTS

| | | | |
|---|---|---|---|
| 2,579,915 | 12/1951 | Flatu et al. | 281/16 |
| 3,028,178 | 4/1962 | Pietrangeli | 281/16 |
| 3,275,343 | 9/1966 | Holm | 281/16 |
| 3,479,752 | 11/1969 | Criger | 281/16 X |
| 4,034,485 | 7/1977 | Milutinovich | 281/16 |

*Primary Examiner*—Willmon Fridie, Jr.
*Attorney, Agent, or Firm*—Oliff & Berridge, PLC

[57] ABSTRACT

The present invention relates to a book with various sections effectively and comfortably to study by referring to the solutions, answers and hints after working out the questions without relying on the solutions answers and hints while the students work out the questions. According to the present invention, there is provided a book with various sections comprising: a plurality of same page sheets means divided into two of more sections, sheets of each sections being formed to be turned independently each other; a front and back cover means for protecting the divided sheets means; and means for binding one side of the divided sheets means and edges of one sides of the front and back cover means together. In case the present invention, the questions are printed in one of said sections while the question explanations, hints, reference matters and correct answers are printed in the other of said sections, thereby conveniently confirming a correct answer, the question explanations, hints, reference material, etc. corresponding to a question after solving the question without relying upon the hints or the question explanations to cause efficiency of study to improve.

8 Claims, 3 Drawing Sheets

BOOK WITH VARIOUS SECTIONS

BACKGROUND OF THE INVENTION

1. Field of the Invention

The present invention relates to a book with various sections for effectively and comfortably studying by referring to the solutions, answers and hints after working out the questions, without relying on the question explanations and hints while the students work out the questions.

2. Description of Related Art

In conventional questions books or reference books, since the question explanations, hints, reference matters and correct answers are generally printed on different pages from which the questions are printed, there is much inconvenience when confirming correct answer, the question explanations, hints, reference matters, etc corresponding to the questions, thereby causing the efficiency of study to deteriorate.

Also, in the case where the question explanations, hints, reference matters, correct answers, etc. are written down in the lower column or rightside/leftside of the pages, when solving the question, because the students have a tendency to rely upon said question explanations, hints, reference matters, correct answers, etc., there is a hinderance in effective studying.

SUMMARY OF THE INVENTION

Accordingly, the present invention is proposed to solve the above described problems, and it is an object of the invention to provide a book with various sections in which sheets of the book are divided into two or more sections with the text or questions being printed in one section and the question explanations, hints, reference matters, correct answers, etc. corresponding to the questions printed in another section.

In order to accomplish the object, the present invention provides a book with various sections comprising: a plurality of same page sheets means divided into two or more sections, sheets of each sections being formed to be turned independently each other; a front and back cover means for protecting the divided sheets means; and means for binding one side of the divided sheets means and edges of one side of the front and back cover means together.

Also, another aspect of the present invention provides a book with various sections comprising: a plurality of same page sheets means divided into two or more sections, sheets of each sections being formed to be turned independently each other; a front cover means for protecting the divided sheets means, said means being formed of two parts; a back cover means for protecting the divided sheets means, said means being formed of one part; and means for binding one side of the divided sheets means and edges of one side of the front cover means and both sides of the back cover means together.

BRIEF DESCRIPTION OF THE DRAWINGS

Additional objects and advantages of the present invention will be more readily apparent from the following detailed description of preferred embodiments thereof when taken together with the accompanying drawings in which.

DETAIL DESCRIPTION OF THE PREFERRED EMBODIMENTS

Now, the embodiments of his invention will be explained in detail hereinafter with referring to the appended drawings.

Figure 1:
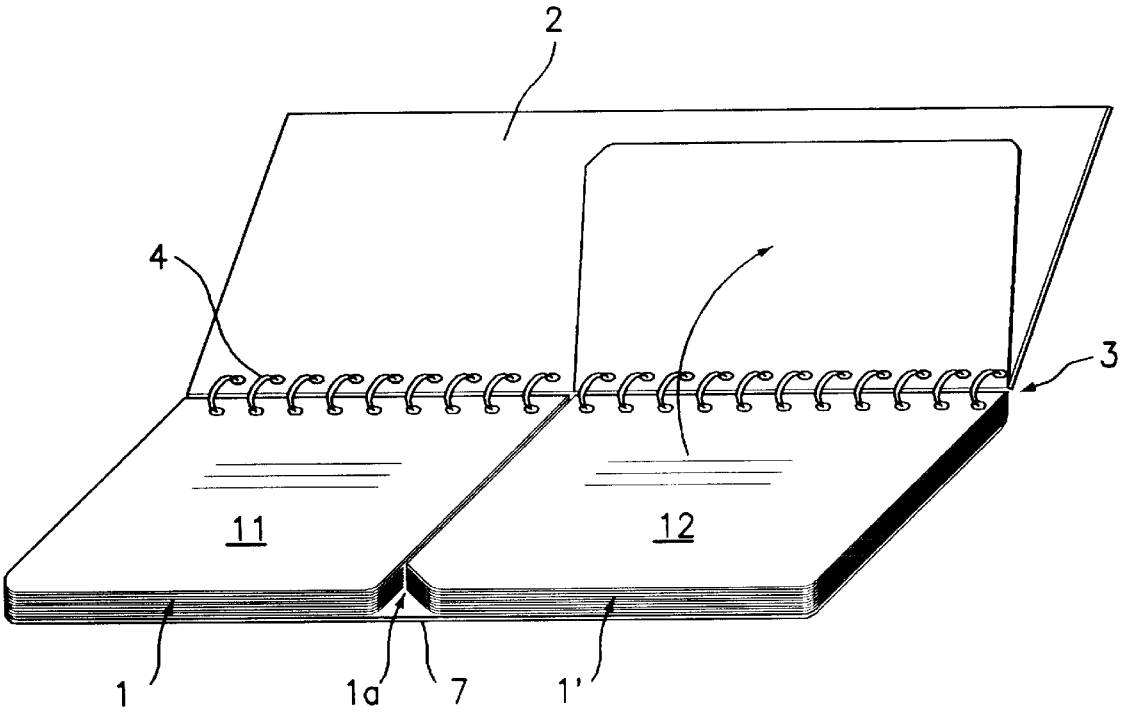
FIG. 1 and FIG. 2 are a schematic views showing the book with two sections divided in accordance with the invention.
Figure 2:
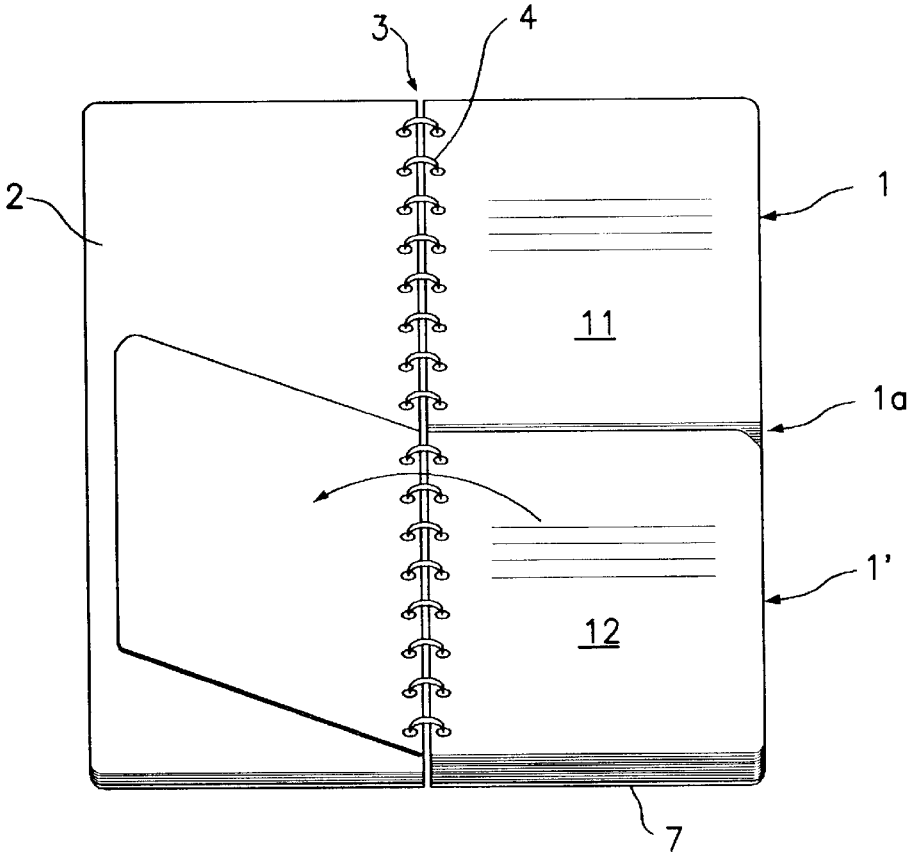
Figure 3:
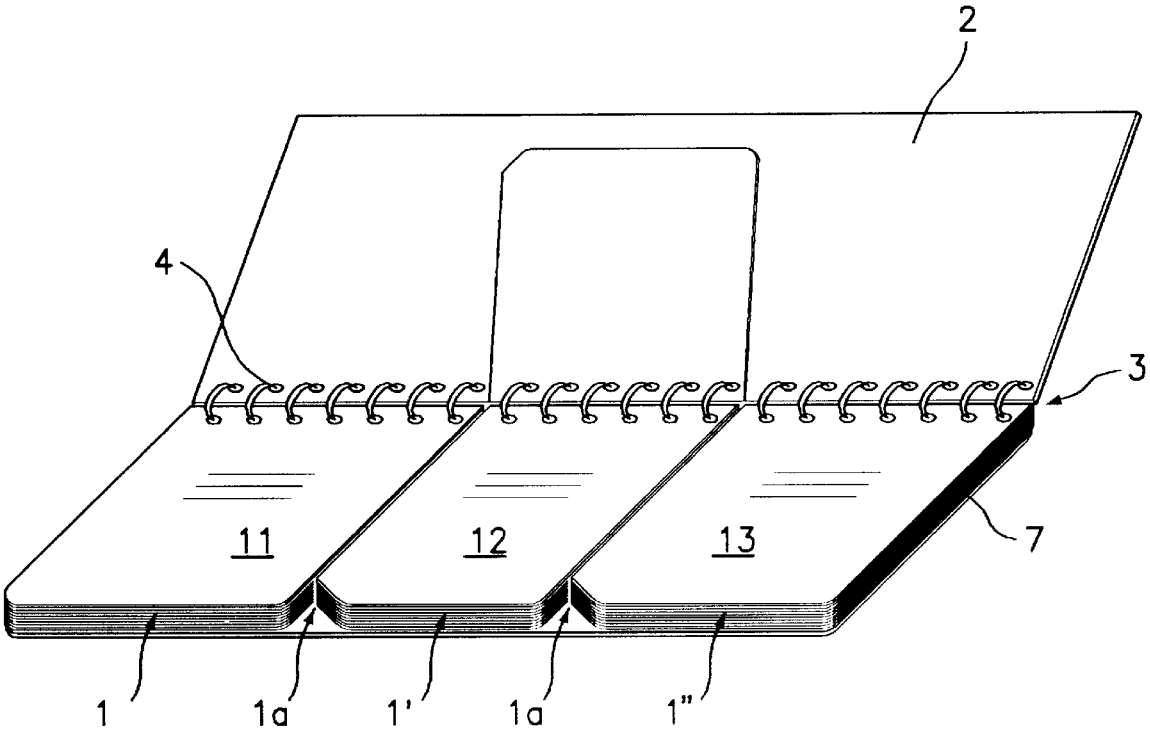
FIG. 3 is a schematic view showing the book with three sections divided in accordance with the invention.
Figure 4:
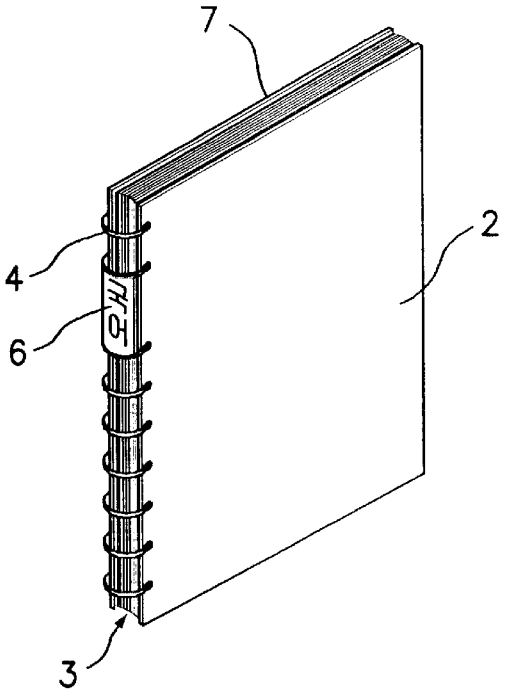
FIG. 4 is a prospective view showing the book with various sections in accordance with the invention.

FIG. 1 and FIG. 2 are a schematic views showing the book with two sections divided in accordance with the invention. FIG. 3 is a schematic view showing the book with three sections divided in accordance with the invention. In the drawings, reference numerals 1, 1', 1" are indicating sections, 1*a* is indicating a corner portion; 2 is indicating a front cover means, 3 is indicating a book binding means, 4 is indicating a coil sprig, 6 is indicating a label, 7 is indicating a back cover means, 11 is indicating section A sheet, 12 is indicating section B sheet, and 13 is indicating section C sheet, respectively.

This invention is adopting a method to dividing the sheets of the book into two sections, three sections, four sections, etc. in a horizontal or vertical direction.

Namely, as shown in FIG. 1 and FIG. 2, a plurality of same page sheets means divided into two or more sections(1, 1', 1") are provided and sheets(11, 12, 13) of each sections(1, 1', 1") are formed to be turned independently each other. Also, front and back covers(2, 7) for protecting the divided sheets means are provided, and one side of the divided sheets means and edges of one side of the front and back covers are bound together by means of binding means(3). Therefore, A sheets(11) of section(1) may be turned separately from B sheets(12) of adjacent section(1'). Said front and back covers(2, 7) are preferably made of material having greater stiffness than those of the sheets(11, 12, 13).

Here, said means for binding the book(3) may be made of coil spring member(4)and moreover said means for binding the book(3) may be made of structure in which each sheet(11 12, 13) of said sections(1, 1', 1") may be easily inserted or taken out Furthermore, corner porition(1*a*) of said section(1, 1') may be cut away to slake it easy to turn the sheets with fingers.

In questions books or reference books according to the present invention, the questions are Printed in one of said sections(1, 1') while the question explanations, hints, reference matters and correct answers are printed in the other of said sections(1, 1'), thereby conveniently confirming a correct answer, the question explanations, hints, reference material, etc. corresponding to a question after solving the question without relying upon the hints or the question explanations to cause the efficiency of study to improve.

Also, in the case of the book with three sections, as shown in FIG. 3, any one of the sections(1') may be formed in note to write down important items, etc.

Figure 5:
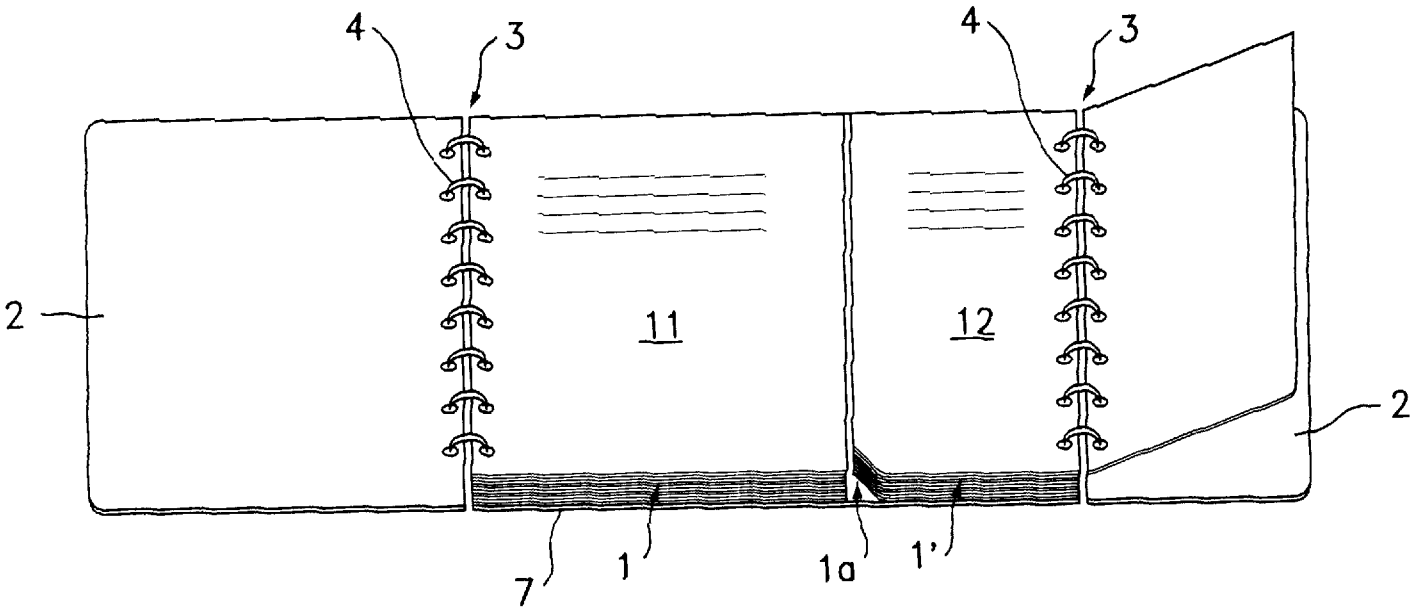
FIG. 5 is a plane view showing the structure of the book with two sections divided in accordance with another embodiment of the invention.

Referring to FIG. 5, there is provided another embodiment of this invention. In this emdodiment, a plurality of same page sheets means are divided into two or more sections(1, 1') and sheets(11, 12) of each sections are formed to be tuned independently each other. A front cover(2) are formed in two parts to protect front surfaces of said divided sheets means(11, 12) and a back cover(7) are formed in one part to protect rear surfaces of the divided sheets means(11, 12) Also, means for binding(3) connects one side of the divided sheets means and edges of one side of the front cover means and both sides of the back cover means together. Therefore, A sheets(11) of section(1) may be turned separately from B sheets(12) of adjacent section(1'). Similarly, said front and back covers(2, 7) are preferably made of material having greater stiffness than those of the sheets(11 12).

Next, a more detailed explanation of the present invention will be described hereinafter.

Referring to FIG. 1 and FIG. 2, there are illustrated the book with two sections. As illustrated in the drawings, the text and/or questions may be printed on a certain page of section A sheets(11), and the hints, question explanations, answers, etc. corresponding to the questions may be printed in section B sheets(12) arranged on different page from the page of section A sheets(11) in which the question are printed. The best way for the students to use this book, for example, is as follows: First the students see only the text and questions in section A page(11) for solving the question without relying on the hints, question explanations, etc. At that time, the students Can't see the hints or explanation of the questions on section B page(12) without opening the pages because the page of section B sheets(12) in which the hints, question explanations, answers, etc. corresponding to the questions are printed is not open If the students have difficulty in solving the problem, they can go to the reference matters in section B page(12). In this case, since the hints, question explanations, answers, etc. corresponding to the questions are next to the questions, the students can confirm very conveniently the correct answer, the question explanations, hints, reference matters, etc. corresponding to the question after solving the question, thereby causing the efficiency of study to improve.

Referring to FIG. 3, there is illustrated the book with three sections. Similarly, the text and/or questions may be printed on a certain page of section A sheets(11), the hints, question explanations, etc. corresponding to the questions may be printed in section B sheets(12), and the answers and explanations may be printed in section C sheets(13). Alternately, one of the sections A, B or C (11, 12, 13) may be used as a note book. A book with four or five sections may be also used in the same manner.

Moreover, for example, the text or very important questions, having a high possibility of being placed on the examination, are placed on any one of each section(1, 1', 1"), thereby causing the students to recognize easily the importance of the contents to remarkably improve the efficiency of study. For example, indicias such as a 80% or more probability, three star mark(☆☆☆) may be expressed regarding the study target matters or very important questions having a high possibility of being placed in examination; indicias such as a 50% or more probability, two star mark(☆☆) may be expressed regarding the second most important questions; and indicias such as a 30% or more probability, one star mark(☆) may be expressed regarding the third most important questions. Therefore, the students may improve their judgement ability regarding importance of a question through self-questioning with respect to "why such indicias are expressed in different manners each other ?".

The printing may be accomplished in a horizontal direction or a vertical direction, depending upon the characteristics or contents of the book, preference of user, etc.

When a book is displayed on a bookshelf in the book stores, the book is generaly positioned so that the book binding portion faces forward. Therefore, in case the book binding means of the book, according to the invention, is made of coil spring, it is very difficult to confirm what the book's subject is. It is desirable to attach a label(6) to coil spring(4) in order to confirm easily the book's subject when the book is displayed on a bookshelf.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

According to the present invention, as the above described, the questions are printed in one of said sections while the question explanations, hints, reference matters and correct answers are printed in the other of said sections, thereby conveniently confirming a correct answer, the question explanations, hints, reference material, etc. corresponding to a question after solving the question without relying upon the hints or the question explanations to cause efficiency of study to improve.

What is claimed is:

1. A book with various sections comprising:

a plurality of book sections each comprising of a plurality of stacked sheets, each book section carrying different contents from each other, and each sheet having a corner portion cut off to facilitate turning with fingers, one of the book sections containing a first set of information comprising at least one of text to be studied and question materials to be solved, and the other one of the book sections contains a second set of information comprising at least one of hints, explanations of the question material, reference matters and correct answers, the first and second book sections being arranged parallel to one another on a same plane so that a sheet of the one of the book sections carrying the first information can be viewed simultaneously with a sheet of the other book section carrying the second information;

at least one front cover for respectively covering and protecting front surfaces of the book sections;

a base cover for supporting the book sections and covering and protecting rear surfaces of the book sections; and a binder that hingedly secures one side edge of one book section to one side edge of the at least one front cover and one side edge of the base cover, and one side edge of the other book section to another side edge of the base cover, the binder including a member made of a coil spring.

2. A book comprising:

at least first and second book sections each comprising a plurality of sheets;

at least one cover for covering and protecting at least one of a front surface and a rear surface of the first and second book sections; and a binder that hingedly secures each of the first and second book sections to the at least one cover so that the sheets of the first book section can be turned independently of the sheets of the second book section, wherein one of the sheets of the first book section contains information corresponding to matching information contained on a selected sheet of the second book section, the selected sheet being the only sheet in the second book section that includes matching information.

3. The book of claim 2, wherein the first book includes a first set of information and the second book includes a second set of information, wherein one of the first and second sets of information comprises at least one of text to be studied and question materials to be solved, and the other of the first and second sets of information comprises at least one of hints, explanations of the question materials, reference matters and correct answers, each relating to the first information.

4. The book of claim 3, wherein the first and second book sections are arranged parallel to one another on the same plane so that a sheet carrying a portion of the first set of information can be viewed simultaneously with a sheet carrying a portion of the second set of information.

5. The book of claim 2, wherein each of the sheets in each of the first and second book sections has a corner portion cut off to facilitate turning with fingers.

6. The book of claim 2, wherein one of the first and second book sections comprises a notebook.

7. The book of claim 2, wherein the binder means is a coil spring.

8. The book of claim 7, further comprising a label attached to the coil spring.

* * * * *